United States Patent [19]

Anthony

[11] 4,286,342

[45] Sep. 1, 1981

[54] TOILET INSTALLATION

[76] Inventor: Alain Anthony, Parc Offenbach, 33, rue Cartault, 92800 Puteaux, France

[21] Appl. No.: 19,646

[22] Filed: Mar. 12, 1979

Related U.S. Application Data

[63] Continuation-in-part of Ser. No. 760,397, Jan. 18, 1977, Pat. No. 4,179,048.

[30] Foreign Application Priority Data

Sep. 28, 1978 [FR] France ..... 78 27808

[51] Int. Cl.[3] ..... E03D 11/10; F16K 31/12; E03D 5/012; E03D 5/02

[52] U.S. Cl. ..... 4/321; 4/431; 4/434; 4/441; 251/61

[58] Field of Search ..... 4/362, 378, 392–396, 4/431–435, 437, 438, 440–442, 319–323, 420, 427, 300; 251/61, 61.1, 357

[56] References Cited

U.S. PATENT DOCUMENTS

| | | | |
|---|---|---|---|
| 289,210 | 11/1887 | Bishop | 4/432 |
| 342,684 | 5/1886 | Cook et al. | 4/394 X |
| 2,315,824 | 4/1943 | Sweeny | 4/433 |
| 3,360,803 | 1/1968 | Gross | 4/393 |
| 3,566,415 | 3/1971 | Culp | 4/435 X |
| 3,698,019 | 10/1972 | Culp | 4/435 X |
| 3,720,962 | 3/1973 | Harrah | 4/435 |
| 3,811,135 | 5/1974 | Drouhard et al. | 4/435 |

FOREIGN PATENT DOCUMENTS

| | | | |
|---|---|---|---|
| 1023903 | 1/1978 | Canada | 4/434 |
| 8637 | of 1897 | United Kingdom | 4/432 |

*Primary Examiner*—Stuart S. Levy
*Attorney, Agent, or Firm*—Diller, Ramik & Wight

[57] ABSTRACT

A toilet installation is disclosed which is especially suited for pleasure boats. A discharge tank is disposed under a toilet fixture and connected with it through an inlet orifice. A flexible obturating member comprising a flexible flap member and a downwardly opening cup-shaped float member is fixed at one side of the inlet orifice so that the flexible obturating member hangs in the discharge tank when the latter is not pressurized. Compressed air from an air compressor is carried through a conduit for pressurizing the discharge tank and expelling the effluent from the discharge tank through a drain orifice, the outlet end of the conduit is aimed at the underside of the float member so that compressed air issuing from the conduit thrusts the obturating member against the inlet orifice thereby sealing off the discharge tank from the tiolet fixture. A second tank for clean water is preferably provided having a distributor valve unit which selectively connects the hollow rim of the toilet fixture with the interior of the second tank for conveying flushing water thereto and brings the conduit into communication with compressed air from the air compressor. Liquid level detectors are provided in the discharge tank to detect the level of effluents. All nonreturn valves provided have similar open float members which are not in the effluent flow path.

12 Claims, 14 Drawing Figures

TOILET INSTALLATION

This application is a Continuation-in-Part of U.S. application Ser. No. 760,397 filed Jan. 18, 1977; now U.S. Pat. No. 4,179,048.

The present invention relates to a toilet fixture installation, particularly for use on a boat.

The invention relates more particularly to water closet and toilet fixture installations remote from their waste collecting units or disposal fields. At present the solid and liquid waste matter is conveyed from the toilet fixture to a remote collecting unit or disposal filed by means of suction pumps or force pumps or pneumatically by means of compressed air, the conveying circuit comprising, of course, check valves preventing the backing up of discharged waste matter.

One of the chief problems to solve for this type of toilet installation resides in the difficulty of obtaining fluid-tight sealing at the valves closing off the various pipes. In fact, good sealing by/means of valves is made difficult, if not impossible, by the presence of solid waste, such as heavy paper, cloth, sticks, match sticks, cigarette butts, which is thrown or dropped into the toilet bowl; moreover, the pivots of such valves are always subject to corrosion and/or sticking. Finally, in the long run, the seats of the valves may become fouled and their floats, which are usually hollow spheres may take in water and thereafter have diffculty in floating properly.

The result is that the effluent backs up into the toilet bowl oozes through sliding seals, giving off nauseating odors.

This situation is particularly distressing on board ships and boats, particularly pleasure boats, where the toilet bowl is below the waterline.

In a device described in U.S. Pat. No. 3,566,415 the waste matter is expelled from the toilet bowl by compressed air and the outlet of the closet is closed off by a semirigid valve member preshaped as a part-spherical cup and mounted at the end of the vertical sliding stem actuated by water under pressure. Although the sealing is better in this device than with rigid valve members, the part-spherical obturating member in this patent is still too rigid owing to its preformed construction to be able to mate perfectly with the fouled edge of the outlet of the toilet, and further, its sliding stem and its associated guide may be immersed in the discharged waste matter, with the consequent drawbacks and risks of corrosion, jamming and sticking, such that the device does not allow this problem to be satisfactorily overcome. Moreover, another problem is posed for small boats; the water closets or toilets/on board such boats are generally located below the waterline. To prevent water outside the boat from flowing back up the waste discharge pipe, the waste discharge pipe is of inverted U-shape in elevation, with its bend above the waterline and an air trap therein which prevents the backing up of water into the discharge tank. Yet, if the waste matter is improperly discharged and the bend in the waste pipe is full of discharged waste matter, the ambient water seeps in, and this starts a siphon action which draws water into the discharge tank. This phenomenon is at first slow but accelerates later as the discharge tank fills and weighs down the boat which could even sink if there is no one on board to stop the siphon action. Such an accident is rather frequent and the sinking of about half of all boats sunk in port occurs in this manner.

The aim of the present invention is the provision of a toilet installation for discharging waste matter from the toilet fixture in total safety, without the chance of effluent backing up or disgusting odors being given off, owing to the perfect sealing of the valves, and also in the prevention of water from backing up into the toilet fixture which might even cause the boat to sink.

The present device according to the invention for discharging waste matter from a toilet fixture, particularly on board a boat, comprises a discharge tank which is positioned below the toilet fixture and provided with a drain hole and an inlet orifice which communicates with the toilet fixture, an obturating member adapted to closely mate with the edge of the inlet orifice to provide a fluit-tight seal and a source of compressed air for pressurizing the discharge tank through an air supply conduit so as to expel effluent including the waste matter through the drain orifice, the obturating member being flexible and fixed at one side to the inlet orifice so that it hangs inside the tank when the tank is not under pressurized and the compressed air supply conduit opens near and directs compressed air towards the obturating member so that it is driven back and urged against the edge of the inlet orifice under the pressure of a blast of compressed air issuing from the conduit.

According to a preferred embodiment of the invention, the installation comprises liquid level detecting means in the discharge tank and means for automatically controlling the operation of the air compressor means and the obturating member in response to the level of effluent in the tank.

According to another preferred embodiment the device comprises a second tank which communicates with a water supply conduit and a compressed air supply conduit connected to said air compressor means for driving out water from the second tank, the second tank including a distributor valve unit responsive to the water level in the second tank and communicating selectively through a line with the toilet fixture for delivering washing, out or flushing water and with the discharge tank for conveying compressed air thereto.

According to the invention the toilet installation for discharging waste matter therefore comprises no mechanical pumping means or any rigid valve members in the effluent flow path, the discharge of the waste matter being effected by increasing the pressure in the discharge tank which collects the same from the outer of the toilet fixture, good fluidtightness produced by the flexibility of the obturating member permitting alone such an increase in pressure in the discharge tank without the chance of backing up into the bowl. The valve fluid-tightness problem is thus resolved in the present installation by disposing the valves outside the flow path of the effluent, the only valve member which must be located in the flow path, i.e. the obturating member at the outlet of the toilet fixture being formed as a flexible flap member fixed at the edge of the inlet orifice of the discharge tank, which eliminates the use of any rigid stem which might corrode or jam the obturating member.

Whatever the solid waste matter or debris entrained by the flushing water, the flexible obturating member properly seals off the discharge tank and prevents the backing up of effluent and offensive odors into the toilet fixture. Further, since the waste matter is expelled under pressure, the present toilet installation may be located remote from a central discharge collector for a building and connected thereto through a long, small-diameter pipe which may have bends for changing levels. The installation is also particularly useful for pleasure boats where the bowl of the toilet is below the waterline. By means of the liquid level detecting means of the present toilet installation, the sinking of boats due to the backing up of ambient water can be prevented.

The invention will now be described in greater detail with reference to preferred embodiments given by way of example and illustrated in the accompanying drawings, in which.

Figure 1:
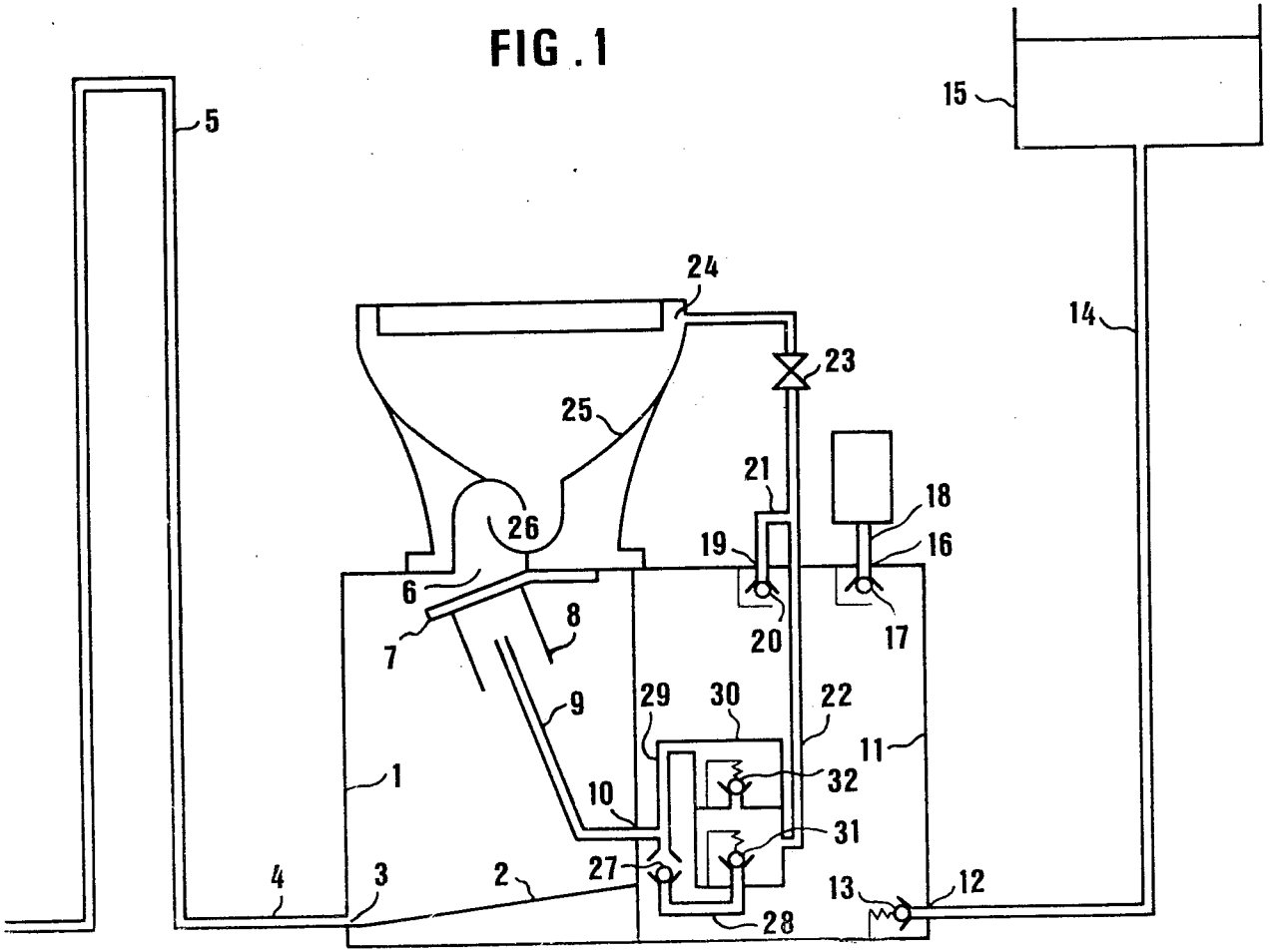
FIG. 1 is a diagrammatic section of the entire toilet installation for discharging waste matter, according to a first embodiment.

The preferred embodiment illustrated in FIG. 1 comprises a so-called discharge tank 1 having an inlet orifice 6 communicating with the toilet fixture having a bowl 25 through its siphon 26. The inlet orifice may be closed off by a flexible flap member or obturating member 7, fixed to the edge of the inlet orifice 6 and provided with a downwardly opening cup-shaped float 8; the obturating member is made, for example, of a flexible plastics material or an elastic material such as rubber. The bottom of the tank 1 is provided with an inclined surface 2 the lower end of which is located proximate to the drain orifice 3E running into a conduit 4 of inverted U-shape in elevation for example, the high point or bend 5 in the conduit being disposed substantially above the level of the bowl. This first tank 1 communicates with a second tank 11, called an accumulation tank, through a tube or conduit 9 through an opening, the outlet end of the tube 9 being disposed inside the cup-shaped float 8. The second tank 11, adjacent to the first, is supplied with flushing or washing out water from a flush tank or cistern 15 through a conduit 14 entering the second tank through an opening 12, the conduit 14 having a check valve 13. The second tank 11 is provided in its upper part with compressed air through a conduit 18 via opening 16, the conduit 18 being provided with a check valve 17 operative in response to the water level for allowing the compressed air to flow into and preventing the water to flow out of said second tank when the level of the float is reached. The source of compressed air in an air compressor in this embodiment. An exhaust valve 20 allows the air to escape from the second tank 11 through tube 21 by way of opening 19. A distributor valve unit 30 is accommodated inside the second tank 11 and has an inlet orifice through which the tube 28 passes, the tube 28 being closed off by a check valve 27 which opens the tube when the level of water is above the float valve member 27 and closes it when it is below. The tube 28 opens into a first chamber via level responsive non-return valve 31, biased closed at a pressure $P_1$ greater than the manometric pressure of the height of water H corresponding to the water level in the reserve tank or cistern 15, but less than the pressure P of the compressed air ($H<P_1<P$). The first chamber communicates with the hollow rim 24 of the toilet bowl through the line 22 which has a stop cock 23. The first chamber communicates with the second chamber via level responsive non-return valve 32 adjusted to a pressure $P_2$ greater than $P_1$ but less than P, ($P_1<P_2<P$), the second chamber being connected directly to a tube 29 which has an inlet in the tank 11 through an opening located vertically below the float valve member 27 which closes the inlet at high water levels and opens it at low water levels.

The tube or conduit 9 which opens inside the cup-shaped float 8 passes through an opening in the common wall separating tanks 1 and 11 and connects up with the tube 29.

The toilet installation operates as follows. After use, the accumulation tank 11 fills up with flushing or washing out water coming from the reserve tank 15; as the water level rises in the accumulation tank, the air trapped inside the tank 11 is exhausted simultaneously through the tubes 9 and 21 until the water level reaches the float valve member 27 which then closes off the tube 29 opening the tube 28. When the level reaches the level responsive valve members 17 and 20, the tubes 18 and 21 are closed off and the tank 11 is completely sealed off since the tube 28 is closed off by the valve member 31 biased closed at a sealing pressure $P_1$ greater than the manometric pressure H of the water in the reserve tank 15. The compressor is then started up and compressed air is carried to the tank 11 through tube 18 via valve member 17; the pressure rises in the second tank 11 up to the preset closure pressure $P_1$ of valve member 31 which eventually opens, and the water is displaced under pressure to the hollow washout rim 24 of the toilet bowl 25 over tube 28 and line 22 via stop cock 23. It will be noted that the rise in pressure is made possible by the fact that the float valve member 20 has previously been urged against its seat by the water and is maintained in its closed position by the compressed air.

Upon flushing the toilet fixture waste matter carried through the siphon 26 falls onto the inclined surface 2 and collects at the drain orifice 3 of the discharge tank 1 while the level of effluent rises, raising the cup-shaped float 8 and the associated obturating member 7 towards the inlet orifice 6 of the discharge tank. In the accumulation tank 11 the level of water drops until it falls below the high position of the float valve member 27 which enables the flow of compressed air through the tubes 29 and 9. The flow of compressed air issuing from the outlet end of tube 9, disposed inside the cup-shaped float 8 thrusts the flexible obturating member 7 against the inlet orifice 6, hermetically sealingly mating with the contour thereof.

Then the pressure rises in the discharge tank 1, which drives the effluent and solid wastes through the drain orifice 3 and the small diameter tube 4 to the common collecting unit. In case the waste matter discharged from the toilet fixture partially fills the discharge tank 1 and the water for flushing the bowl could cause the discharge tank 1 to overflow, the stop cock 23 is closed and the air compressor is put into operation. The pressure rises in the second accumulation tank 11, and when it reaches a pressure $P_1$, this causes the preset valve member 31 to open; water fills the first chamber but, since it is trapped, not being able to escape through the line 22 as before, the pressure continues to rise reaching pressure $P_2$ which is the preset biasing pressure acting on valve member 32 which then opens.

The water under pressure then flows into the second chamber of the distribution valve unit, through tubes 29 and 9 and into the discharge tank 1 in which the water level rises to the cup-shaped float 8, urging the flexible obturating member 7 against the inlet orifice 6, thereby sealing it off. The air compressor continues to blow the water out of the accumulation tak 11 which is then blown into the first tank 1 and drained therefrom via the drain orifice 3. When the water level in the accumulation tank 11 drops below the level of the preset valve member 27, the compressed air is delivered to the discharge tank 1 and keeps the flexible obturating member 7 pressed against the orifice 6 while the effluent is expelled through the orifice 3 and tube 4.

It will be realized that in the above described embodiment of the installation the rigid valve members are located in the clean water in the accumulation tank 11 and only the flexible obturating member 7 is located in the flow path of waste matter, which obturating member, due to its inherent pliability is able to intimately conform to the contour of the inlet orifice 6, hermetically sealing off the same whatever solid waste matter is flushed out of the toilet bowl.

Different modifications can of course be envisaged.

Thus, for instance, the flexible obturating member 7 for the inlet orifice 6 may be replaced by an inflatable obturating member of ball shape fixed at a position on the edge of the inlet orifice 6, the wall of the inlet orifice having a frustoconical portion flared toward the interior of the tank 1. When such an inflatable obturating member is at rest, it is deflated and hangs next to the inlet orifice 6, and when the compressed air is driven from the accumulation tank 11 into the discharge tank 1, it first blows up the deflated obturating member which, blown up, seals off the frustoconical wall of the orifice 6, the fluid-tightness is then enhanced as the pressure rises in the discharge tank 1, forcing the inflated ball into the frustoconical wall of the orifice.

Similarly the installation may be simplified, provision being made for only one of the discharge and accumulation tanks, i.e. the discharge tank, the conduit 9 being connected directly to the source of compressed air. In such a simplified arrangement the reserve tank or cistern 15 communicates directly with the bowl 25 through the conduit 14 which then opens in the hollow washout rim 24 of the bowl. A water meter mounted on the conduit 14 permits the measuring of the amount of water conveyed to the bowl for flushing out waste matter and the simultaneous control of both the valve to cut off the flow of water and the starting of an air compressor connected to the tube 9.

The measuring of the flushing water carried to the toilet fixture and the starting of the air compressor may both be controlled by a float gauge disposed in the discharge tank 1, the float being, for example, the cup-shaped float integral with the flexible obturating member 7. The operation is as follows. After use, water in the accumulation tank 15 is delivered to the bowl 25 and is discharged into the discharge tank 1 until a predetermined volume of effluent fills the discharge tank; the meter or jauge stops the flow of flushing water and starts the air compressor. The compressed air thrusts the obturating member against the inlet orifice 6 of the discharge tank 1 and liquid and solid waste matter is dischaged as described hereinabove.

A baffle or deflector may also be positioned in the cup-shaped float 8 so as to create a swirling of the air and effluent in order to unstick and dislodge any solid wastes from the wall of the discharge tank 1 to facilitate their discharge.

Figure 2:
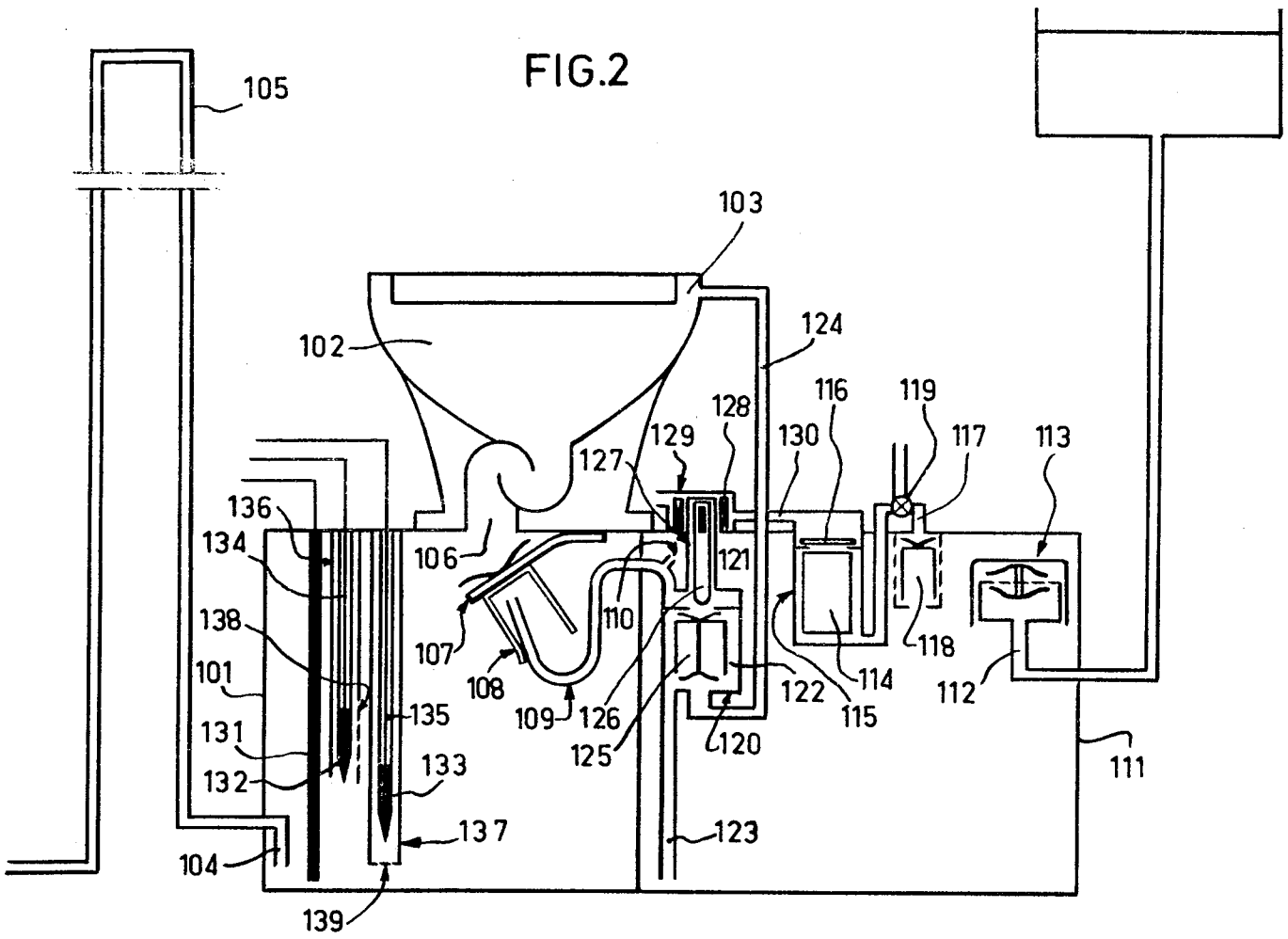
FIG. 2 is a similar view illustrating a modified form of the installation according to a second embodiment.
Figure 3:
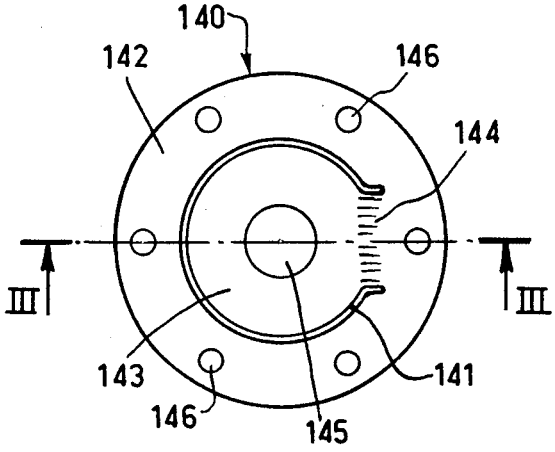
FIG. 3 shows a flexible obturating member for the installation.
Figure 5:
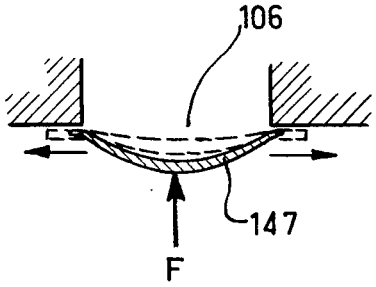
FIG. 5 illustrates the deformation of the valve member on the obturating member in the closed position.
Figure 4:
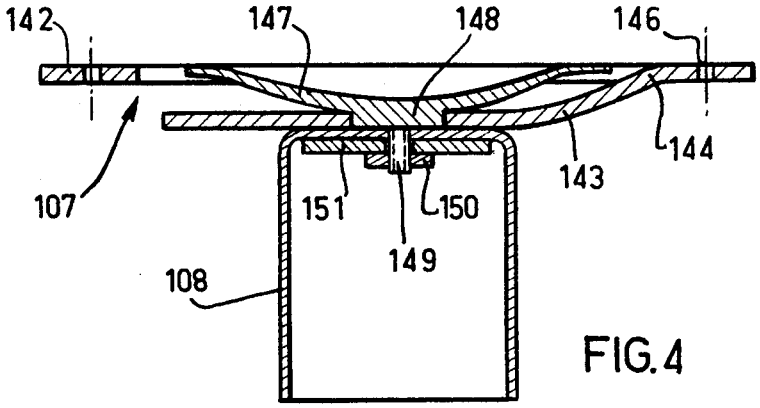
FIG. 4 shows the flexible obturating member in cross section taken on the line III—III in FIG. 3.

In a second preferred embodiment, illustrated in FIG. 2, the toilet installation comprises, under the toilet fixture including a bowl 102, a discharge tank 101 having an inlet orifice 106 communicating with the toilet bowl through a siphon, the inlet orifice 106 being sealed off by a flexible obturating member 107 fixed to the edge of the inlet orifice 106 and provided with a flexible downwardly opening cup-shaped float 108 which is made as well as the obturating member 107, for example, of flexible or pliable plastics material or of an elastic material such as rubber. The bottom of the discharge tank 101 is provided with a channel which amasses the waste matter at the lower part of the tank 101, proximate to a drain elbow 104 connected to a drain pipe 105 which may be of inverted U-shape in elevation, with its bend at the highest point located above the water line of the boat. Inside the discharge tank 101 are three vertical level detectors 131,132 and 133 electrically connected for detecting the effluent level in the first tank. The first level detector 131 is a grounded or earth detector and its lower end is in the vicinity of the bottom of the discharge tank, the second level detector 132 is called a "first stop" detector with its lower end higher than the lower end of the third level detector or level maintaining detector 133. Each of the three level detectors comprises a graphite stick or electrode with a pointed lower end. The level detectors 132 and 133 are fixed to the ends of plastic rods 134 and 135 and housed inside vertical protective tubes 136 and 137 having their lower ends open. The tube 136 housing the first stop level detector 132 has a plurality of vent holes 138 at its lower end to allow air to escape when the liquid level rises in the tube. On the other hand, the tube 137 housing the level maintaining detector 133 has no vent holes and extends below the lower end of the associated graphite stick, its opening being substantially at the same level as the orifice of the drain elbow 104 and having a screen 139 to prevent solid matter from rising in the tube.

The discharge tank 101 communicates with a second tank 111 called "accumulation tank" through an S-shaped tube 109 which terminates in the cup-shaped float 108. The other end of the tube 109 is connected to a distributor valve unit 120 which is accommodated in the accumulation tank 111 and communicates with the same through a diving tube 123 and with the hollow rim 103 of the toilet bowl 102 through a line 124. The flow of water is divided between discharge tank 101 and the toilet bowl rim 103 by means of a float valve member 125 with seals, verticaly displaceable in the body 122 of the distributor valve unit 120. An electromagnetically actuatable plunger 126 is provided above the float valve member 125 for unsticking it from its raised position after the toilet fixture has been flushed out.

A sealed vessel 115 containing a small air compressor 114, for example a bladed air compressor, is positioned inside the accumulation tank 111 and a transistorized printed circuit 116 is electrically connected to the level detectors 131, 132 and 133 for controlling the air compressor. The sealed vessel 115 communicates to the surroundings through a tube 130 which carries ambient air to the air compressor 114 via the printed circuit 116 for cooling the latter, the compressed air being delivered into the accumulation tank 111 through a tube 117 having an elbow above the tank, the outlet end of the tube 117 being closed off by a level response valve device 118 for avoiding the potential backing up of water into the elbow. A three-way valve 119 is provided at the elbow 117, which valve can be connected to an inflating device, such as a hand pump or foot operated inflater, for use in case of a breakdown of the air compressor 114. It shall be noted that the air compressor 114 is acoustically isolated owing to its being housed inside the vessel 115 in the accumulation tank 111.

Water is supplied to the accumulation tank 111 through a supply conduit 112 which communicates with a reserve tank or with the surroundings and delivers water to the accumulation tank through a vertical rising tube portion, the outlet end of which is provided with a double-action valve device 113 having controlled one-way micro-leaking or bleeding means.

Finally, there is provided an electrical switch (not shown) on the seat of the toilet which switch is connected to the air compressor for automatic actuation when the lid is pivoted to its closed position.

These various valve arrangements are illustrated in greater detail in FIGS. 3–7.

The flexible obturating member 107 closing off the inlet orifice 106 of the discharge tank 101 comprises a flexible flap member 140 (FIG. 3) with a part-circular slit 141 so as to partially separate the central portion 143 from an annular peripheral portion 142 while nevertheless being connected by a portion 144 serving as a hinge between the central and peripheral portions 143 and 142. An aperture 145 is disposed in the central portion 143, and holes 146 for fasteners are spaced around the peripheral portion 142.

A dish-shaped flexible valve member 147 is mounted on one face of the central portion 143 of the flexible flap member (FIG. 4), which valve member has a thickened base 148 serving to locate it in the aperture 145 in the flap member. A cup-shaped float 108 is secured to the opposite side of the flap member, the skirt of the cup-shaped float being elastically deformable and the bottom thereof being traversed by a threaded pin 149 fixed to the base 148 of the valve member. The threaded pin joins the assembly together, including the valve member, the central portion 143 of the membrane and the float 108 in cooperation with a nut 150 and a rigid washer 151 which is interposed between nut 150 and the bottom of the float 108 and serves to rigidify the center of the obturating member 107.

The obturating member 107 is fixed to the upper wall of the discharge tank 101 by means of screws passing through holes 146 so that the peripheral portion 142 surrounds the inlet orifice 106, the central portion 143 of the flap member 140 bending about the hinge portion 144 connecting with the peripheral portion 142 and hanging inside the discharge tank 101.

It will be noted that the flexibility of the skirt of the cup-shaped float 108 allows its deformation when the float bears against the tube 109 (FIG. 2) and thereby permits a greater opening of the obturating member 107. The flexible valve member 147 has a thin elastically deformable edge making it self-cleaning by a wiping action.

In fact, since the valve member, upon its closure, is subjected to a force F (FIG. 5) its edge bears against the edge of the inlet orifice to be sealed off, it then deforms radially, rubbing against its seat, thereby pushing outwardly any possible clogging substances which might foul the sealing surface of the sealing member.

Figure 6:
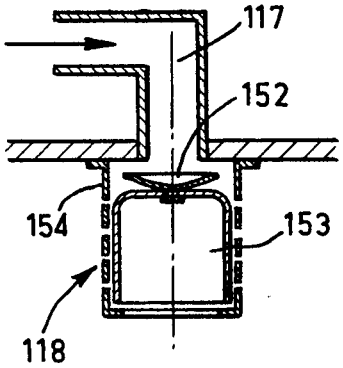
FIG. 6 shows, on an enlarged scale, a level responsive valve arrangement for the air supply conduit of the second embodiment.

The level responsive valve device 118 which serves to seal off the compressed air line 117 comprises, as shown in FIG. 6, a downwardly opening cup-shaped float 153 having a valve member 152 at its upper end, which cup-shaped float is vertically displaceable in a cylindrical guiding cage 154 fixed to the upper wall of the accumulation tank 111, the cage comprising a perforate lateral wall allowing the flow of air and an open lower end enabling water to rise inside the float.

Figure 7:
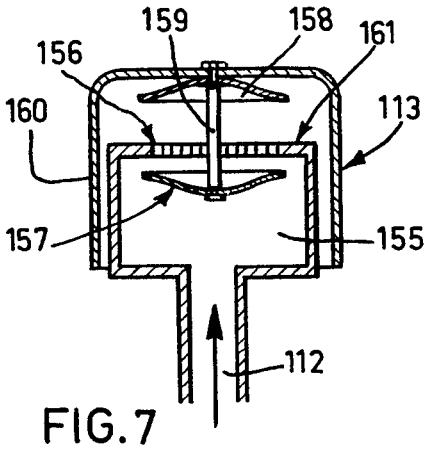
FIG. 7 is a longitudinal sectional view, on an enlarged scale, of the double-action valve arrangement for the water supply conduit in the second embodiment.

The double-action valve device 113 which regulates the inflow of water into the accumulation tank 111 comprises, as shown in FIG. 7, a downwardly opening cup-shaped float 160 having a central guide stem 159 on which are mounted, facing each other, an upwardly oriented dish-shaped lower valve member 157 and a downwardly oriented dish-shaped upper valve member 158. The valve members 157 and 158 are adapted to bear selectively against the upper wall of an admission chamber 155 disposed at the outlet of the vertical rising portion of the supply conduit 112, for sealing off ports 156 in the upper wall.

At least one groove 161 connected to at least one of the ports 156 at the periphery is provided on the upper side of the perforate wall, the groove extends the or each hole beyond the zone covered by the upper valve member 158 so that, even when the upper valve member 158 is closed there, is still a small passageway ensuring communication between the interior of the accumulation tank 111 and the water admission chamber 155; on the other hand, as the groove 161 is only formed in the upper side of the perforate wall, the valve is entirely closed and fluid-tightness is complete in the opposite direction when the lower valve member 157 is urged against the underside of the perforate wall of the admission chamber 155. The groove 161 thus provides a controlled countercurrent leaking or bleeding of the supply water.

Figure 8:
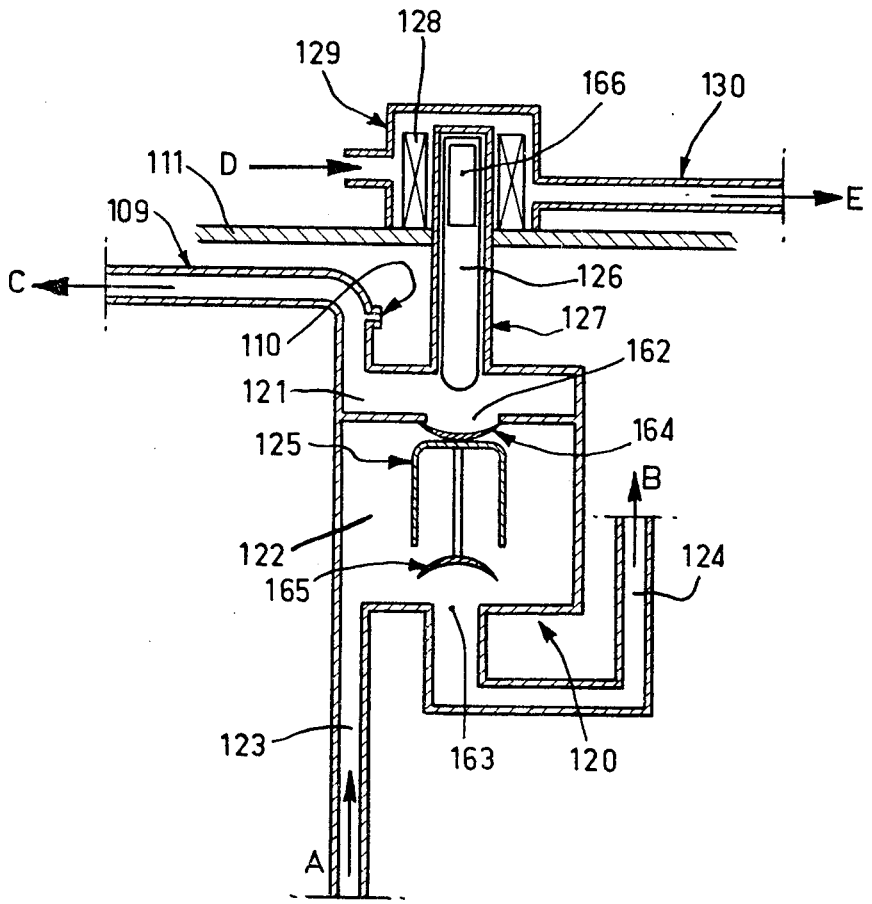
FIG. 8 is a longitudinal sectional view, on an enlarged scale, of the distributor valve unit for distributing compressed air and washing out water in the second embodiment.

As illustrated in FIG. 8, the distributor valve unit 120 comprises a hollow body 122 in communication at its upper end through an orifice 162 with an upper chamber 121 and at its lower end with the accumulated tank 111 through the diving tube 123 which opens near the bottom of the accumulation tank and with the rim 103 of the bowl through an outlet opening 163 and line 124. A downwardly opening cup-shaped float 125 provided with upper and lower valve members 164 and 165, interconnected by a stem, are displaceable vertically inside the hollow body 122 so as to seal off selectively orifices 162 and 163 disposed substantially above each other, the guding of the float for vertical movement being effected by any suitable means, such as, for example, a perforated guide tube (not shown) accommodating the float. The upper chamber 121 is in communication with the discharge tank 101 by means of tube 109, said tube having a decompression vent hole 110 of small predetermined size opening in the accumulation tank 111. A fluid-tight tubular housing 127 forms an upward continuation of the upper chamber 121, passing through and beyond the upper wall of the accumulation tank 111. The tubular housing 127 which is located in line with the superposed orifices 162 and 163 serves to house a plunger 126 mounted for vertical sliding movement therein, the plunger having a permanent magnet 166 at its upper end. An induction coil 128 is disposed about the portion of the tubular housing 127 which is situated above the upper wall of the tank 111, surrounding the permanent magnet 166 when the plunger 126 is in its raised position. A protective case 129 encloses the coil 128 and communicates with both the vessel 115 for the air compressor through the tube 130 and the surroundings through an air intake provided on the side of the coil 128 opposite the open end of the tube 130 so that fresh air drawn into the air compressor cools both the printed circuit 116 and the coil 128.

The just described embodiment operates as follows. As the installation is ready to be used, the level of effluent in the discharge tank 101 is minimal and just touches the orifice of the drain elbow 104 and the screen 139 at the lower end of tube 137, the flexible obturating member 107 hangs down, opening the inlet orifice, and the accumulation tank 111 is filled with clean water. The water level in the accumulation tank 111 buoys the float 125 of the distributor valve unit upwards as well as the float 153 of the level responsive valve 118 and the float 160 of the double-action valve device 113 such that the distributor valve unit affords communication between the tank 111 and the hollow rim 103 of the bowl, the water supply being cut off.

When the user lowers the lid of the toilet seat, the associated switch is actuated and the electrical circuit turned on, which starts the air compressor 114, blowing air into the accumulation tank 111; the float 118 is thrust downwards by the compressed air and so is the float 160 whose upper valve member 158 seals off the ports 156 in the perforate wall of the admission chamber 155, a controlled compressed air leak develops through the passageway or groove 161 from the tank 111 towards the inside of the admission chamber 155 in order to clean out the supply conduit 112 and flush out any solid, fouling matter which could possibly have reached the same.

As the pressure rises in the tank 111, water is delivered to the distributor valve unit 120 through the diving tube 123 and is carried to the hollow rim 103 of the toilet bowl via orifice 163 and line 124. The clean, flushing water washes out the toilet and falls into the discharge tank 101 whose liquid level mounts and reaches the first stop level detector 132 which sends electric pulses simultaneously to the transistorized time-delay printed circuit 116 and the coil 128. The circuit 116 turns off the air compressor for a preset period (about 8 seconds) required for the decompression of the accumulation tank 111, the compressed air being exhausted through the vent hole 110 and the tube 109 into the discharge tank 101 which is open. At this stage of operation, the level of clean water has dropped below the inlet opening of the diving tube 125, which draws the water from near the bottom of the tank 111 whereby the float 125 of the distributor valve unit is no longer buoyed by either the water or the compressed air, the latter having been exhausted through the vent hole 110. Also, a small impact of the plunger 126, thrust downwards by the electromagnetic force of the coil 128 against the permanent magnet 166, is sufficient to unstick the valve member 164 from its seat, causing the float 125 to fall by gravity, the lower valve member 165 closing the orifice 163. The air compressor 114 is started up by the time-delay circuit 116 again, the pressure in the tank 111 increases again despite the controlled leak through the small air vent 110 whose flow rate is small compared to that of the air compressor. The water remaining in the accumulation tank 111 above the level of the opening of the siphon tube 123 is surged by the pressure of the compressed air into the body 122 of the distributor valve unit then through the upper orifice 162 which is open, and sprayed from the tube 109 into the cup-shaped float 108, the force of the spray leaving the tube 109 lifting the obturating member 107 and thrusting the valve member 147 against its seat, thereby closing the orifice 106; as soon as the remaining water has been expelled, a blast of compressed air enters the discharge tank 101, which keeps the obturating member 107 closed and causes the pressure to mount in the discharge tank.

It will be noted that, owing to the fact that protective tube 137 of the level maintaining detector 133 extends lower than the detector itself and has no air vents, air trapped in the tube 137 precludes the level of effluent from mounting as long as the tank 101 is not under pressure, hence the lower end of the first stop detector 132 alone is in contact with the effluent before the rise in pressure in the tank 101. But when the pressure rises, the effluent is expelled through the drain elbow 104, its level falls below the lower end of the first stop detector level tube 132 while at the same time the level in this tube 137 rises above the lower end of the level maintaining detector 133 which stays in contact with the earth or grounded detector 131 and keeps the circuit closed, thereby keeping the air compressor in operation. When the effluent including solid waste matter has been completely drained and the level in the tank has fallen to the level of the screen 139, closing off the bottom of the tube 137, the effluent is no longer in contact with the lower end of the level maintaining detector 133 and the air compressor stops automatically. The pressure then falls in the both tanks 101 and 111, the obturating member 107 is released and falls back, freeing the orifice 106; the supply water can once again buoy up the upper valve member 158 and enter the accumulation tank 111 through ports 156. The level of clean water rises and lifts the float 125 whose upper valve member 164 seals off the orifice communicating between the distributor valve unit and the tank 101, while the communication between the hollow rim of the toilet is reestablished; then the float 160 of the double-action valve device 113 is, in turn, lifted thereby shutting off the supply of water. The device is once again ready to operate. In case siphon action is re-established in the drain tube 105, gradually filling the discharge tank 101, as soon as the liquid level reaches the tip of the first stop detector 132, the operating cycle of the installation picks up with the time delay phase of the air compressor 114 and energization of the coil 128 and there is no flushing of the toilet then, because this could cause the overflow of the toilet bowl, as the flushing water would be adding to the water already drawn in.

The result is the same when several successive users forget to lower the lid of the toilet seat and therefore do not trigger the discharge cycle; either if no user has lowered the lid, the discharge cycle is triggered automatically, without washing out the bowl, when the liquid level attains the first stop detector 132, or if the last of successive users lowers the lid when the level is already near the tip of the first stop detector 132, the washing out or flushing out is triggered but interrupted immediately, as soon as liquid level reaches the first stop detector 132 which detector stops the air compressor and energizes the coil 128, the cycle then picking up after the washing out step.

In no case can the toilet bowl overflow and therefore the boat sink.

Preferably, all the valve members of the installation are dish-shaped with elastically deformable peripheral edges, like the valve member of the obturating member 107 so as to be self-cleaning, too. It will be noted that none of the floats is fluid-tight but on the contrary they all open downwardly so as to empty automatically when the water level falls, which is not so with so-called fluid-tight float when they take in water. Moreover, the fact of placing the graphite level detectors 132 and 133 at the ends of rods 134 and 135 of plastics material and housing them inside protective tubes, fluid-tight at the level of said rods provides dry surfaces in the tubes and on the rods and therefore good electrical insulation between each level detector and its protective tube.

The invention is, of course, not limited to the preferred embodiments of the invention, described above, but covers all modifications, and equivalents within scope the appended claims.

The originality and effectiveness of the flexible obturator previously described with reference to FIGS. 1 to 4 reside in the fact that it is essentially constituted by a flexible diaphragm fixed laterally, without any mechanical hinge, at the edge of the inlet orifice of the tank to be closed and provided on its lower surface turned towards the inside of said tank with a float of inverted bell or cup shape into which a compressed fluid inlet pipe opens. When the liquid level rises in the tank, the closing of the obturator is initiated by the float which, in floating, lifts the diaphragm, said closing being completed by a fluid jet under pressure spurting inside the cup or bell of the float when a certain level is reached.

This obturator offers the essential advantage of not having any rigid member nor mechanical articulation with an axle or pivot in the path of the liquid and solid waste, which is most important; however, this obturator operates through a compressed air inlet pipe opening inside the bell of the float and the part of this pipe situated inside the tank can constitute a trapping support for certain waste materials (threads, newspaper pages, pieces of rag, strips of cloth, etc. . . . ) which could wind around the latter and eventually reduce the space available in the tank.

Consequently, in another embodiment of the toilet installation according to the invention operating by the same principle as that previously described, the undesirable presence in the toilet tank of any compressed fluid inlet pipe is avoided.

According to this modification, the toilet installation, notably for water closet bowls on boats, comprises a discharge tank placed below the level of the latter and provided with a drain hole and with an inlet orifice which communicates with said bowl, a flattened flexible obturating member which can closely fit the edge of the inlet orifice to close it in fluid-tight manner, and a source of compressed fluid connected to the discharge tank by an inlet pipe enabling it to be placed under pressure to discharge the waste through the drain hole, the flexible obturating member being connected on the one side to the edge of the inlet orifice by a pliable connecting zone which connects it to hang inside the tank when the latter is not under pressure, and at least one compressed fluid outlet opening at the level of said obturating member so that the latter is lifted and flattened against the edge of the inlet orifice under the effect of the fluid pressure, the obturating member including in addition an internal cavity communicating with said compressed fluid outlet through a channel formed in the flexible connecting zone between this obturating member and the edge of the inlet orifice of the discharge tank. In a preferred form, the obturating member includes at least one outlet orifice for the compressed fluid, outside the inner cavity, on its lower surface directed towards the inside of the tank. Preferably also, the obturating member includes on its upper surface directed towards the inlet orifice of the tank a valve in the form of a dish whose edge is elastically deformable and intended, on closing, to clean by friction its support surface around said orifice by radial deformation under the thrust of compressed fluid Finally, on its inner surface directed towards the inside of the tank, the flexible obturating member can also, preferentially, include a downwardly open cup or bell-shaped float whose lateral wall surrounds the outlet orifices of the compressed fluid outside the inner cavity of said obturating member.

Figure 9:
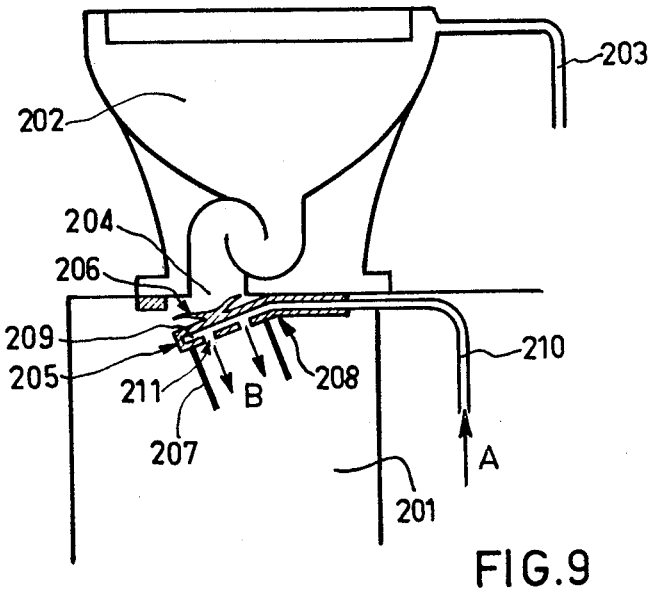
FIG. 9 shows a diagrammatic section of a modification of the toilet installation according to a third embodiment.

As shown diagrammatically in FIG. 9, the toilet installation according to this modification includes a discharge tank 201 surmounted by a water closet 202 provided with a flush water pipe 203 and communicating at the lower part with said tank through an inlet orifice 204, this orifice being closable by a flexible obturating member or obturator 205 of flexible fluid-tight material, of plastics, rubber or the like. The obturator 205 includes, on its upper surface directed towards the orifice 204 to be closed, a deformable valve 206 in the form of a dish and, on its lower surface directed towards the inside, a float 207 in the form of a downwardly open bell or cup; in addition, this obturator 205 is fixed on one side by a connecting zone 208 at the edge of the inlet orifice 204, so that, in inactive condition and due to the fact that it is flexible, it folds at the level of the connecting zone 208 and hangs inside the tank 201, thus freeing the inlet of the latter.

In the diagrammatic view of FIG. 9, the obturator is in the form of a flat hollow member whose inner cavity 209 is placed in communication with the outlet of an inlet pipe 210 connected to a source of compressed fluid (not shown), the pressurized fluid arriving in the direction of the arrow A and emerging from the cavity 209 in the direction of the arrows B through outlet holes 211 pierced in the inner wall of the obturator and opening inside the cup or bell of the float 207.

Figure 10:
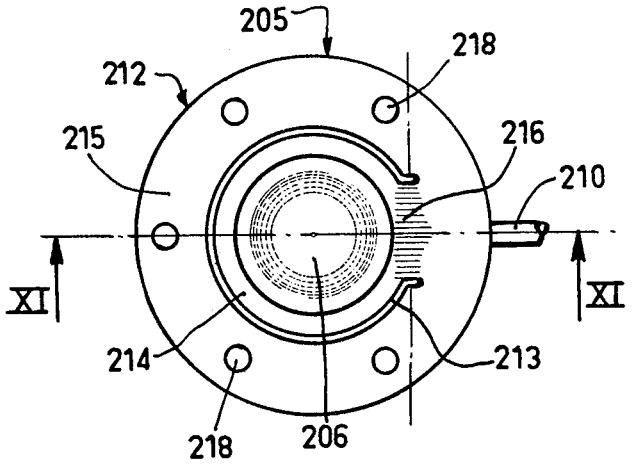
FIG. 10 is a top view of the flexible obturating member of FIG. 9.
Figure 11:
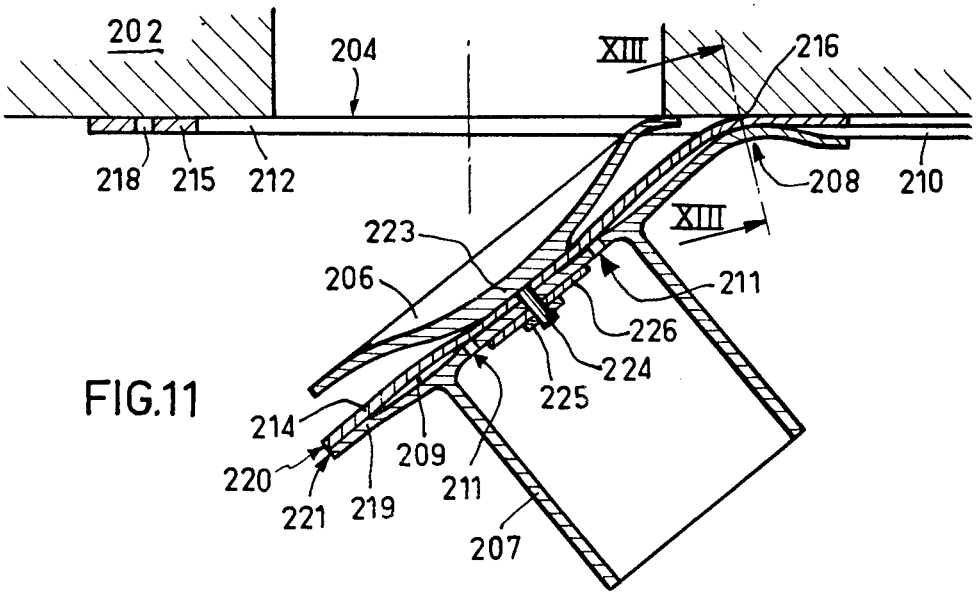
FIG. 11 is an enlarged sectional view of the obturator of FIG. 10 along the diametral line XI—XI, the obturator being shown open.
Figure 12:
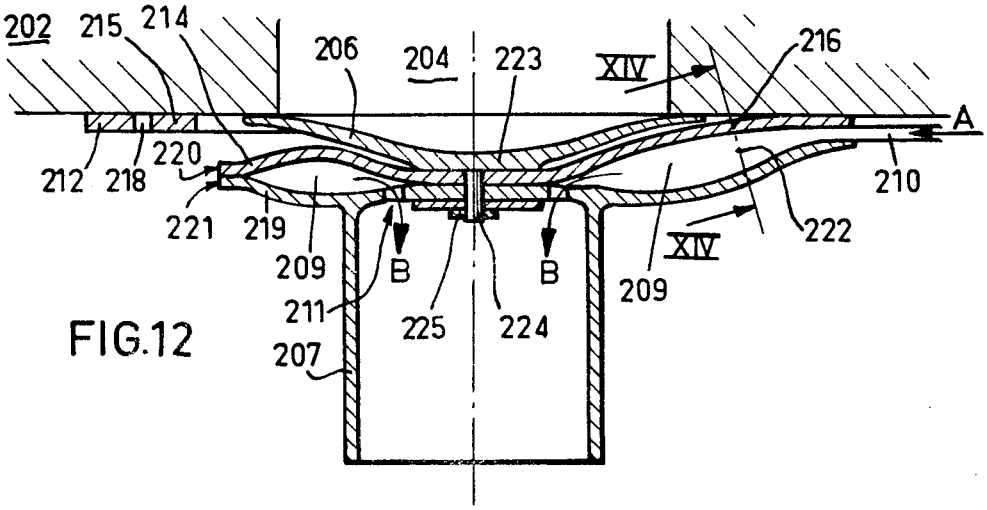
FIG. 12 is a sectional view similar to that of FIG. 11 but with the obturator shown closed.

The obturator 205 is shown in more detail and in a particular embodiment in FIGS. 10, 11 and 12. In these figures, the obturator includes a flexible upper diaphragm 212 in which a circular cut-out 213 has been made so as to partly detach the central portion 214 of a peripheral ring 215, the latter remaining nonetheless connected together by a portion 216 enabling flexion with respect to one another. A bore 217 is provided in the central portion 214 and fastening holes 218 are formed in the peripheral ring 215.

A second diaphragm 219 (FIGS. 11 and 12), having the same cut-out as the central portion 214, is coupled to the latter against its inner surface, and the superposed edges 220 and 221 of the two cut-outs are fixed together in fluid-tight manner by welding or gluing, or by any other suitable means, the fluid-tight fastening being effected over the whole periphery of the contiguous edges with the exception of the zone situated below the portion 216 reserved for folding and corresponding to the connecting zone 208 of the obturator; this non-fixed zone constitutes a channel 222 placing in communication with the outside, the chamber or inner cavity 209 thus formed between the non-fixed parts of the facing surfaces of the two diaphragms 212 and 219, this channel 222 receiving the outlet mouth of the compressed fluid inlet pipe 210.

Against the upper surface of the central portion 214 of the diaphragm 212 is mounted (FIG. 11) the dish shaped flexible valve 206 provided with a bottom 223 which is thicker, conferring on it a good seating on the diaphragm 214; against the opposite surface of the obturator is provided a cup or bell-shaped float 207 in one piece, whose skirt is elastically deformable and whose bottom, constituted by the diaphragm 219, is traversed by a threaded rod 224 fast to the bottom 223 of the valve, said rod serving to connect together, by means of a nut 225, the valve, the part 214 cut-out in the diaphragm 212 and the inner diaphragm 219 to which the float is coupled, a rigid washer 226 interposed between the nut 225, and the bottom of the float 207 serving to grip firmly the central portions of the two diaphragms 212 and 219 against one another and to effect fluid-tightness around the rod 224.

The obturator 205 is fixed to the upper wall of the tank 201 by means of screws passing through the holes 218 and so that the ring 215 surrounds the inlet orifice 204, the central part 214 of the membrane 212 being folded at the level of its connecting strip 216 with the ring 215 and hanging inside the tank 201.

In addition, it will be noted that the valve 206 has a thin elastically deformable edge which renders it self-cleaning (FIG. 12).

In fact, on closing, the valve being subjected to subadjacent pressure, the edge becomes applied against the edge of the orifice 204 to be closed, then is deformed radially by wiping against its seat, which pushes outwardly the possible soiling which could clog the contact area of the fluidtight seal.

There will also be noted the holes 211 formed in the bottom of the float 207 through the diaphragm 219 and ensuring communication between the inside of the bell of the float and consequently of the tank 201 and the inside of the chamber or cavity 209 enclosed in the obturator.

Figure 13:
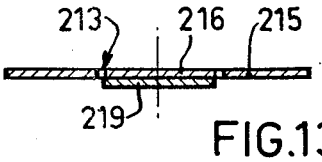
FIGS. 13 and 14 are cross sectional views of the flexible connecting zone of the obturator respectively along the lines XIII—XIII and XIV—XIV of FIGS. 11 and 12, in the cases where the obturator is respectively open and closed.

The obturator described above operates as follows:

In inactive position (FIGS. 11 and 13), that is to say when the discharge tank 201 is not under pressure, the obturator hangs inside the latter, the diaphragms 212 and 219 being folded at the level of the connecting zone 216 of the central part 214 to the outer ring 215; in this condition, the inner chamber 209 occupies practically no space and the inlet channel 222 formed in the connecting zone of the obturator has a section crushed at the level of the fold 208 (FIG. 13).

Figure 14:
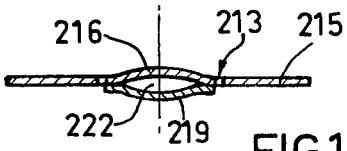

On closing (FIGS. 12 and 14), a fluid is sent under pressure (arrow A) into the pipe 210 for example compressed air or water under pressure, and the pressure of this fluid forces the two diaphragms 212 and 219 to separate at the level of the fold 208 (FIG. 14) so as to open the passage cross-section of the channel 222 at this spot. The swelling of the coupling zone causes the lifting of the obturator and allows the compressed fluid to enter its chamber or inner cavity 209; this fluid then escapes (arrows B) through the one or more outlet orifices 211 pierced in the inner diaphragm 219 constituting the bottom of the bell of the float 207 and, by reaction, flattens the obturator and its valve against its seat, thus ensuring a closing which is all the tighter as the pressure rises in the tank 201.

It is to be noted that the lifting of the obturator could already be started before the arrival of the pressurized fluid in the pipe 210 by the floating of the float 207 on the rising level of the waste water collected in the tank.

When the waste matter has been discharged, the pressure falls again and the intake of compressed fluid is interrupted, which causes the falling of the obturator 205 again whose diaphragms fold at the level of the connecting zone 216 due to the fact that they are no longer held separated (FIG. 13); the obturator resumes its inactive position illustrated in FIG. 11 thus freeing the inlet orifice 204 of the tank 201.

Of course, the scope of the invention is not limited to the single embodiment described above but extends to modifications which would differ only in detail.

Thus of course, the obturator may be formed of a single part instead of being formed of two coupled diaphragms; in the same way, the cup or bell float 207 can be fastened under the diaphragm 219 instead of forming an integral portion of the latter.

Similarly, it is not indispensable to provide compressed fluid outlet orifices through the diaphgram 219, the closing of the obturator being in this case formed simply first by the reascent of the float with the level of waste water, then by the swelling, on the one hand, of the passage cross-section of the channel 222 at the level of the fold 208 (zone 216) and, on the other hand, of the obturator itself whose inner annular chamber 209 expands under the fluid pressure. Of course, it is unnecessary in this case to provide a direct inlet for the fluid into the tank 201 to place the latter under pressure.

It will nonetheless be preferred to provide these holes 211 for the outlet of compressed fluid in the bell or cup of the float since the reaction caused by the fluid jets emerging from the chamber 209 of the obturator improves the closing by accelerating it.

I claim:

1. A toilet installation comprising a toilet fixture, a discharge tank disposed beneath said toilet fixture and having a drain orifice and an inlet orifice in communication with said fixture, an obturating member adapted to sealingly mate with the edge defining said inlet orifice to seal it off and a source of compressed fluid connected to said discharge tank through conduit means for pressurizing said discharge tank and expelling effluent including waste matter through the drain orifice, wherein the improvement comprises said obturating member having a pliable edge portion serving as a hinge to connect said obturating member to one side of said inlet orifice, and to permit said obturating member to hang into said discharge tank in open nonsealed relationship to said inlet orifice when the latter is unpressurized, said conduit means having an outlet end proximate to and aimed at said obturating member whereby a blast of fluid issuing from said conduit means outlet end thrusts said obturating member back and urges it against the edge of said inlet orifice to sealingly close the latter.

2. A toilet installation according to claim 1, wherein said obturating member comprises flexible flap member, and a downwardly opening cup-shaped float member being provided on the side of said flexible flap member facing from said inlet opening.

3. A toilet installation according to claim 2, wherein said flexible obturating member comprises a dish-shaped valve member on the opposite side of said flexible flap member, the periphery of said dish-shaped valve member being elastically deformable and adapted to wipe, in its closed position, its bearing surface around the edge of said inlet orifice by radial deformation in response to the thrust exerted by the fluid in the pressurized discharge tank.

4. A toilet installation according to claim 2, wherein the outlet end of said conduit means is generally covered by said downwardly opening cup-shaped float member so that a blast of compressed fluid issuing from said conduit means is imparted against said float member.

5. A toilet installation according to claim 4, wherein the sidewall of said float member is elastically deformable to afford greater flexing of said obturating member.

6. A toilet installation according to claim 1, wherein the obturator is hollow and its inner cavity communicates with said compressed fluid outlet through a channel formed in said hinge.

7. A toilet installation according to claim 6, wherein the obturator includes, on its inner surface directed towards the inside of the tank, at least one orifice for the outlet of compressed fluid from its inner cavity.

8. A toilet installation according to claim 6, wherein the obturator includes, on its upper surface directed towards the inlet orifice of the tank, a dish-shaped valve member whose edge is elastically deformable and designed, on closing, to clean by friction its support surface around said orifice by radial deformation under the thrust of the compressed fluid.

9. A toilet installation according to claim 6, wherein on its inner surface directed towards the inside of the tank, the flexible obturator includes a downwardly open cup or bell-shaped float whose lateral wall surrounds the outlet orifices of the compressed fluid from the inner cavity of said obturator.

10. A toilet installation according to claim 9, wherein the float forms an integral part of the obturator.

11. A toilet installation according to claim 9, wherein the float is fastened against the lower surface of the obturator.

12. A toilet installation according to claim 6 wherein the body of the obturator is essentially constituted by two diaphragms coupled and fixed together in fluid tight manner around their periphery, with the exception of said hinge, and in which a passage is thus preserved communicating the inside of the obturator with the outside.

* * * * *